US012221664B2

(12) United States Patent
Takayama et al.

(10) Patent No.: US 12,221,664 B2
(45) Date of Patent: Feb. 11, 2025

(54) APPARATUS FOR MANUFACTURING THIN STEEL SHEET AND METHOD FOR MANUFACTURING THIN STEEL SHEET

(71) Applicant: NIPPON STEEL CORPORATION, Tokyo (JP)

(72) Inventors: Takuya Takayama, Tokyo (JP); Hiroshi Harada, Tokyo (JP); Kenji Yamada, Tokyo (JP); Masashi Sakamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 846 days.

(21) Appl. No.: 17/292,984

(22) PCT Filed: Nov. 8, 2019

(86) PCT No.: PCT/JP2019/043817
§ 371 (c)(1),
(2) Date: May 11, 2021

(87) PCT Pub. No.: WO2020/100729
PCT Pub. Date: May 22, 2020

(65) Prior Publication Data

US 2022/0002829 A1 Jan. 6, 2022

(30) Foreign Application Priority Data

Nov. 14, 2018 (JP) ..... 2018-213447

(51) Int. Cl.
*C21D 9/46* (2006.01)
*B21B 1/46* (2006.01)
(Continued)

(52) U.S. Cl.
CPC ..... *C21D 9/46* (2013.01); *B21B 1/463* (2013.01); *B22D 11/1287* (2013.01);
(Continued)

(58) Field of Classification Search
CPC ..... C21D 9/46; C21D 6/005; C21D 6/008; C21D 8/0205; C21D 8/0226; B21B 1/463;
(Continued)

(56) References Cited

U.S. PATENT DOCUMENTS 5,564,178 A 10/1996 Takashima et al.
5,634,257 A 6/1997 Kajiwara et al.
(Continued)

FOREIGN PATENT DOCUMENTS

CA 1 341 120 A 10/2000
CN 105121062 A 12/2015
(Continued)

OTHER PUBLICATIONS

WO89/11363A1 Translation (Year: 1989).*

*Primary Examiner* — Brian D Walck
*Assistant Examiner* — Danielle Carda
(74) *Attorney, Agent, or Firm* — Birch, Stewart, Kolasch & Birch, LLP

(57) ABSTRACT

Using an apparatus for manufacturing a thin steel sheet including the followings which are arranged in order: a continuous casting machine (1) for a thin slab having a slab thickness of 70 mm to 120 mm at a lower end of a mold; a holding furnace (2) that is configured to maintain a temperature of a cast slab (10) and/or heats the cast slab (10); and a rolling stand (3) by which finish rolling is performed, the casting speed of the thin slab is set to 4 to 7 m/min, the slab (10) is reduced at a rolling reduction of 30% or more by the reduction roll (4) after solidification is completed and when a center temperature of the slab is 1300° C. or higher, and the slab (10) is held at a temperature of 1150° C. or higher and 1300° C. or lower for five minutes or longer in the holding furnace (2).

12 Claims, 1 Drawing Sheet

(51) Int. Cl.

| | |
|---|---|
| ***B22D 11/128*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |

(52) U.S. Cl.
CPC ..... *C21D 6/005* (2013.01); *C21D 6/008* (2013.01); *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01)

(58) Field of Classification Search
CPC ..... B21B 1/466; B21B 2201/14; B21B 1/46; B22D 11/1287; B22D 11/00; B22D 11/12; B22D 11/128; C22C 38/001; C22C 38/002; C22C 38/02; C22C 38/04; C22C 38/06; C22C 38/14; C22C 38/00; C22C 38/58; C22C 38/42; C22C 38/44; C22C 38/48; C22C 38/50
USPC ..... 148/541
See application file for complete search history.

(56) References Cited

U.S. PATENT DOCUMENTS

| | | | | |
|---|---|---|---|---|
| 5,871,040 | A * | 2/1999 | Kaseda | B22D 11/115 164/486 |
| 2010/0212856 | A1 | 8/2010 | Rosenthal et al. | |
| 2012/0175076 | A1 | 7/2012 | Seidel et al. | |
| 2016/0089714 | A1 | 3/2016 | Yamanaka et al. | |
| 2020/0056254 | A1* | 2/2020 | Li | C22C 38/26 |

FOREIGN PATENT DOCUMENTS

| | | | | | |
|---|---|---|---|---|---|
| CN | 106515606 | A | | 3/2017 | |
| JP | 3-504572 | A | | 10/1991 | |
| JP | 05-015904 | A | * | 1/1993 | B21B 1/46 |
| JP | 5-15904 | A | | 1/1993 | |
| JP | 7-204708 | A | | 8/1995 | |
| JP | 7-308701 | A | | 11/1995 | |
| JP | 11-239804 | A | | 9/1999 | |
| JP | 11-239851 | A | | 9/1999 | |
| JP | 2009-508691 | A | | 3/2009 | |
| JP | 2015-6680 | A | | 1/2015 | |
| JP | 2015006680 | A | * | 1/2015 | |
| JP | 2015-217392 | A | | 12/2015 | |
| JP | 2016-175104 | A | | 10/2018 | |
| RU | 2 036 030 | C1 | | 5/1995 | |
| TW | 201105438 | A1 | | 2/2011 | |
| WO | WO-8911363 | A | * | 11/1989 | B21B 1/463 |

* cited by examiner

APPARATUS FOR MANUFACTURING THIN STEEL SHEET AND METHOD FOR MANUFACTURING THIN STEEL SHEET

TECHNICAL FIELD OF THE INVENTION

The present invention relates to an apparatus for manufacturing a thin steel sheet and a method for manufacturing a thin steel sheet.

Priority is claimed on Japanese Patent Application No. 2018-213447, filed Nov. 14, 2018, the content of which is incorporated herein by reference.

RELATED ART

Thin steel sheets for vehicles and the like are manufactured through hot rolling or further cold rolling using slabs as a material. In recent years, thin steel sheets for vehicles have been required to be thin in order to reduce the weight, and thin materials having a sheet thickness of less than 1.2 mm are also required. When such a thin material is to be manufactured on a rolling line in the related art, there is a problem that a rolling load increases and it becomes difficult to pass the top and bottom of a coil.

On the other hand, a line (hereinafter, thin slab casting and rolling (TSCR)) in which a continuous casting machine for thin slabs and a rolling line are combined is known. This is a line in which continuous casting of thin slabs and a hot rolling line are directly connected, and is characterized in that the line is more compact than a process in the related art, and endless rolling can be performed by rolling slabs cast by the continuous casting without cutting the slabs. When manufacturing a thin steel sheet which is thin as described above, since the thin slab is a starting material, a rolling load can be reduced. Furthermore, since the endless rolling is performed, the frequency at which the top and the bottom of a coil are passed during rolling can be extremely reduced. Therefore, it is possible to significantly reduce the problem of passability in rolling. Therefore, stable manufacturing of thin steel sheets having a sheet thickness of less than 1.2 mm can be expected.

Patent Document 1 discloses a method for manufacturing a strip by casting and rolling, which is TSCR, in which a thin slab is first cast in a casting apparatus, and the thin slab is subsequently rolled in one or more rolling lines using the primary heat of the casting process. Here, the cast thin slab passes through a holding furnace and an induction furnace between the casting apparatus and the one or more rolling lines. The holding furnace and the induction furnace are started or stopped, or controlled or adjusted depending on selected operation modes, that is, a first operation mode in which a strip is continuously manufactured, and a second operation mode in which a strip is discontinuously manufactured.

Patent Document 2 discloses a continuous manufacturing method, which is TSCR, in which a steel strip or sheet steel is manufactured from a thin slab manufactured by a curved continuous casting method having a horizontal discharge direction. Here, after a continuous casting material is solidified, the thin slab is formed in a first forming step at a temperature higher than 1100° C. Induction heating is performed again over the entire cross section of the thin slab to a temperature of about 1100° C. with the best possible temperature compensation. The thin slab is formed at a rolling rate corresponding to each roll in at least one second forming step.

Patent Document 3 discloses a continuous casting method of a steel slab, which is a continuous casting method of a steel slab characterized in that immediately after the center of a slab in a thickness direction is solidified so that, based on a primary dendrite arm spacing $\lambda_0$ in the center of a slab in a thickness direction in a case where casting is performed without performing a reduction, a value $\lambda/\lambda_0$ of a ratio of a primary dendrite arm spacing $\lambda$ in the center of the slab in the thickness direction to $\lambda_0$ becomes 0.1 to 0.8, a reduction is performed so that a reduction ratio which is a value obtained by dividing the thickness of the slab immediately before the reduction by the thickness of the slab immediately after the reduction becomes 1.41 or more and 2.00 or less.

PRIOR ART DOCUMENT

Patent Document

[Patent Document 1] Published Japanese Translation No. 2009-508691 of the PCT International Publication

[Patent Document 2] Published Japanese Translation No. H3-504572 of the PCT International Publication

[Patent Document 3] Japanese Unexamined Patent Application, First Publication No. 2015-6680

DISCLOSURE OF THE INVENTION

Problems to be Solved by the Invention

As described above, by using TSCR, especially when manufacturing a thin steel sheet which is reduced in thickness, it is possible to avoid the problem of increasing the rolling load and the problem of passing the top and bottom of the coil. On the other hand, materials of thin steel sheets for vehicles are made to cope with high-strengthening in order to prevent a decrease in rigidity due to a decrease in thickness. The component system of a high strength steel sheet is a high alloy steel system (high Mn steel). Since a thin steel sheet of a high alloy steel system has significant segregation, there are problems in the deterioration of the material due to the segregation and the aesthetic appearance of the surface of the steel sheet. In a rolling line in the related art, diffusion of segregation can be performed by soaking a slab manufactured by continuous casting. On the other hand, as described above, in TSCR, since the cast slab is immediately rolled into a thin steel sheet, there is a problem that segregation cannot be improved by the soaking treatment.

An object of the present invention is to provide an apparatus for manufacturing a thin steel sheet and a method for manufacturing a thin steel sheet, capable of stably manufacturing a thin steel sheet, which is of a high alloy steel system and has little segregation, by TSCR.

Means for Solving the Problem

That is, the gist of the present invention is as follows.

(1) In an apparatus for manufacturing a thin steel sheet with which continuous casting, passing-through a holding furnace, and finish rolling are able to be continuously performed without cutting a slab, the apparatus including: a continuous casting machine for a thin slab having a slab thickness of 70 mm to 120 mm at a lower end of a mold; the holding furnace that is configured to maintain a temperature of a cast slab and/or heats the cast slab; and a rolling stand by which finish rolling is performed are arranged in order, the apparatus has a reduction roll on a downstream side of a solidification completion position of the slab in the continuous casting machine, and the slab is able to be reduced by the reduction roll.

(2) In (1), the holding furnace may be one of a furnace in which the slab passes through an atmosphere kept at a high temperature and a furnace in which the slab is heated by induction heating.

(3) A method for manufacturing a thin steel sheet using the apparatus for manufacturing a thin steel sheet according to (1) or (2), may include: setting the casting speed of the thin slab at the lower end of the mold to 4 to 7 m/min; and reducing the slab at a rolling reduction of 30% or more by the reduction roll after solidification is completed and when a center temperature of the slab is 1300° C. or higher.

(4) A method for manufacturing a thin steel sheet using the apparatus for manufacturing a thin steel sheet according to (1) or (2), may include: setting the casting speed of the thin slab at the lower end of the mold to 4 to 7 m/min; reducing the slab at a rolling reduction of 30% or more by the reduction roll after solidification is completed and when a center temperature of the slab is 1300° C. or higher; and holding the slab at a temperature of 1150° C. or higher and 1300° C. or lower for five minutes or longer in the holding furnace.

(5) In (3) or (4), the thin steel sheet may contain, as a chemical composition, by mass %; C: 0.01% to 1.0%, Si: 0.02% to 2.00%, Mn: 0.1% to 3.5%, P: 0.02% or less, S: 0.002% to 0.030%, Al: 0.0005% to 0.0500%, N: 0.002% to 0.010%, O: 0.0001% to 0.0150%, and a remainder consisting of Fe and impurities.

(6) In (5), the thin steel sheet may further contain one or two or more of, by mass %; Ti: 0.005% to 0.030%, Nb: 0.0010% to 0.0150%, V: 0.010% to 0.150%, B: 0.0001% to 0.0100%, Cr: 0.01% to 2.00%, Ni: 0.01% to 2.00%, Cu: 0.01% to 2.00%, Mo: 0.01% to 1.00%, and W: 0.01% to 1.00%.

Effects of the Invention

According to the present invention, when manufacturing a thin steel sheet in a line in which a continuous casting machine for a thin slab, a holding furnace that is configured to maintain the temperature of a slab and/or heats the slab, and a rolling line are combined, it is possible to stably manufacture a thin steel sheet, which is of a high alloy steel system and has less segregation.

EMBODIMENTS OF THE INVENTION

Figure 1:
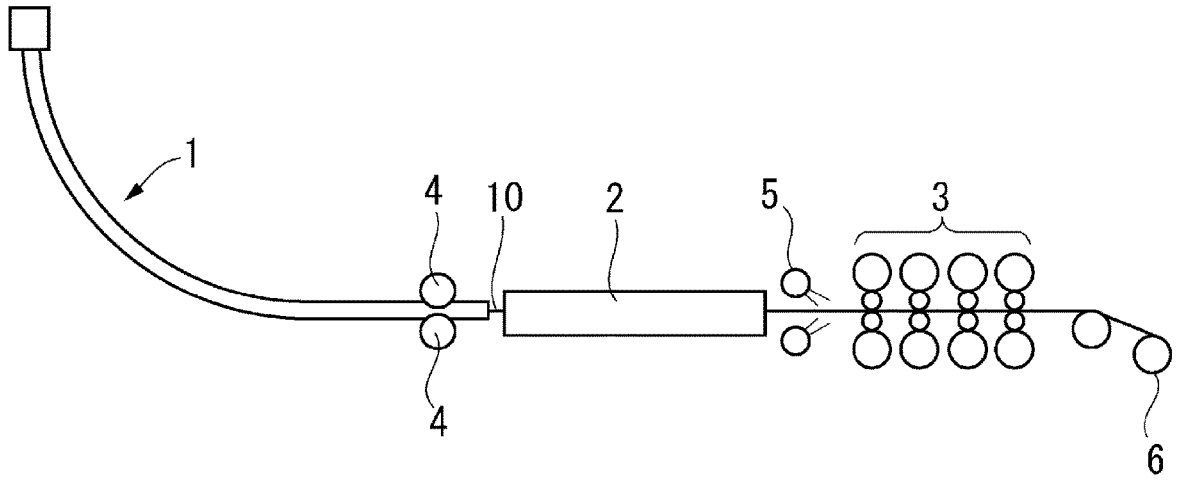
FIG. 1 is a diagram schematically illustrating an apparatus for manufacturing a thin steel sheet.

It is known that, as described in Patent Document 3, when a reduction is performed under specific conditions immediately after the thickness center of a slab is solidified in a continuous casting machine, a segregation interval can be shortened, and segregation elements can be diffused and made harmless even in a short heat treatment. The same document also discloses a method of adding Bi, Sn, and Te as a method of refining a dendrite structure which is the segregation interval. In the same document, continuous casting methods under conditions under which a mold thickness is 200 mm or more and a casting speed is about 1 m/min are examined.

As a method for stably manufacturing a thin steel sheet of a high alloy steel system having no segregation, a process that combines continuous casting (CC) capable of high speed casting with a slab thickness of about 100 mm in a mold and compact hot rolling was considered, and optimum conditions for casting conditions, heating conditions, and rolling conditions were investigated.

It was considered that by reducing the slab immediately after solidification was completed in the continuous casting machine, the slab after the reduction was held at a high temperature in a heat treatment furnace, whereby macrosegregation of the central part of the slab and microsegregation between dendritic trees were further reduced.

Therefore, an experiment was conducted in which slabs to be cast in cases of a condition A and a condition B were rolled after the completion of solidification and immediately after hot solidification in a machine of the continuous casting machine. After the completion of the solidification, the slab was reduced at a rolling reduction of 30% to 50% in a region in which the center temperature of the slab was 1300° C. or higher. Then, after the slab was discharged from the continuous casting machine, the slab was immediately cut, and the cut slab was immediately placed in a holding furnace held at 1250° C. and subjected to a heat treatment to be held in the furnace for 10 minutes to 60 minutes. In the case of the condition A, a case where neither reduction nor heat treatment was performed, a case where a reduction was performed at a rolling reduction of 30% but no heat treatment was performed, and a case where a reduction was performed at rolling reductions of 30%, 40%, and 50% and a heat treatment was performed at 1250° C. for a heat treatment time of 10 minutes and 60 minutes were compared to each other, and a center segregation ratio and a microsegregation ratio under each condition were obtained. In the case of the condition B, a case where neither reduction nor heat treatment was performed, a case where a reduction was performed at a rolling reduction of 30% but no heat treatment was performed, and a case where a reduction was performed at rolling reductions of 30% and 50% and a heat treatment was performed for a heat treatment time of 10 minutes and 60 minutes were compared to each other, and a center segregation ratio and a microsegregation ratio under each condition were obtained. For the measurement of the center segregation ratio, the concentration of Mn in the vicinity of the thickness center of a section perpendicular to a rolling direction of the slab was analyzed by line analysis in a thickness direction with a beam diameter of 50 μm using EPMA, a Mn concentration distribution in the slab was measured, and the maximum concentration of Mn in a measurement range was obtained. Then, a value obtained by dividing the value of the maximum concentration of Mn by an initial Mn content rate (2.40 mass %) obtained from a chemical analysis in a molten steel stage was used as the center segregation ratio. For the measurement of the microsegregation ratio, the same slab as in the measurement of the center segregation was used, and line analysis was performed in a width direction at a ¼ slab thickness. Then, a value obtained by dividing the value of the maximum concentration of Mn from the distribution of Mn concentrated on primary dendrite arms by the initial Mn content rate obtained from the chemical analysis in the molten steel stage was used as the microsegregation ratio. Here, the rolling reduction (%) by a reduction roll was obtained as "(slab thickness before reduction−slab thickness after reduction)/slab thickness before reduction×100".

TABLE 1

| Continuous casting | | Holding furnace | Slab quality after heat treatment | |
|---|---|---|---|---|
| Casting condition | Rolling reduction % | Heat treatment time (min) | Center segregation ratio | Microsegregation ratio |
| Condition A | 0 | 0 | 1.36 | 1.44 |
| 100 mm | 30 | 0 | 1.28 | 1.37 |
| thick | | 10 | 1.25 | 1.34 |
| | | 60 | 1.21 | 1.31 |
| | 40 | 10 | 1.20 | 1.30 |
| | | 60 | 1.18 | 1.28 |
| | 50 | 10 | 1.13 | 1.19 |
| | | 60 | 1.11 | 1.16 |
| Condition B | 0 | 0 | 1.52 | 1.57 |
| 200 mm | 30 | 0 | 1.44 | 1.49 |
| thick | | 10 | 1.41 | 1.46 |
| | | 60 | 1.38 | 1.42 |
| | 50 | 10 | 1.27 | 1.30 |
| | | 60 | 1.24 | 1.27 |

From Table 1, it was found that as the rolling reduction increases and the heat treatment time lengthens, both the center segregation ratio and the microsegregation ratio approached one indicating segregation free, and an improvement was achieved. Furthermore, it was found that the condition A for continuous casting of a thin slab has a greater effect of improving the segregation ratio than the condition B for continuous casting of a thick slab in the related art.

The reason why the center segregation ratio and the microsegregation ratio were improved by the reduction immediately after the completion of the solidification and the heat treatment immediately after the casting in high speed casting by the continuous casting of a thin slab is considered as follows. That is, the reason why the center segregation ratio and the microsegregation ratio were improved by the reduction immediately after the completion of the solidification and the heat treatment is that there is a possibility that dislocations introduced at the time of the reduction may become diffusion paths of the segregation elements and may be diffused at a high speed. In addition, it is considered that the reason for the improvement in segregation is that the center segregation is extended in a longitudinal direction of the rolling by the reduction, and due to the reduced thickness, the time until the center segregation is diffused is shortened. Such a diffusion mechanism is consistent with the improvement in the center segregation ratio achieved even though an active heat treatment is not performed in the holding furnace at a rolling reduction of 30%. It is considered that since the slab is reduced when the center temperature of the slab is 1300° C. or higher, there is a certain period of time that the temperature of the central part of the slab is around 1300° C. even after the reduction, and the segregation elements are diffused during this period. Regarding the microsegregation, similar to the center segregation, a microsegregation interval is shortened by the reduction, and the diffusion of the segregation elements is promoted, so that segregation is improved.

In continuous casting of a thin slab according to the present embodiment, a slab thickness at the lower end of a mold is set to 70 mm to 120 mm. In addition, a casting speed of the thin slab at the lower end of the mold is set to 4 to 7 m/min. By casting a thin slab having a thickness of 120 mm or less at a speed as high as 4 m/min or more, a dendrite arm spacing immediately after the completion of solidification can be refined, and a center segregation ratio and a microsegregation ratio immediately after the completion of the solidification can also be reduced. On the other hand, by reason of productivity, the lower limit of the thickness of the slab is set to 70 mm. Furthermore, by reason of casting problems such as breakout, the upper limit of the casting speed is set to 7 m/min. In a continuous casting machine, after a solidified shell has passed through the mold, an unsolidification reduction may be performed in a roll band to reduce the slab thickness.

Figure 2:
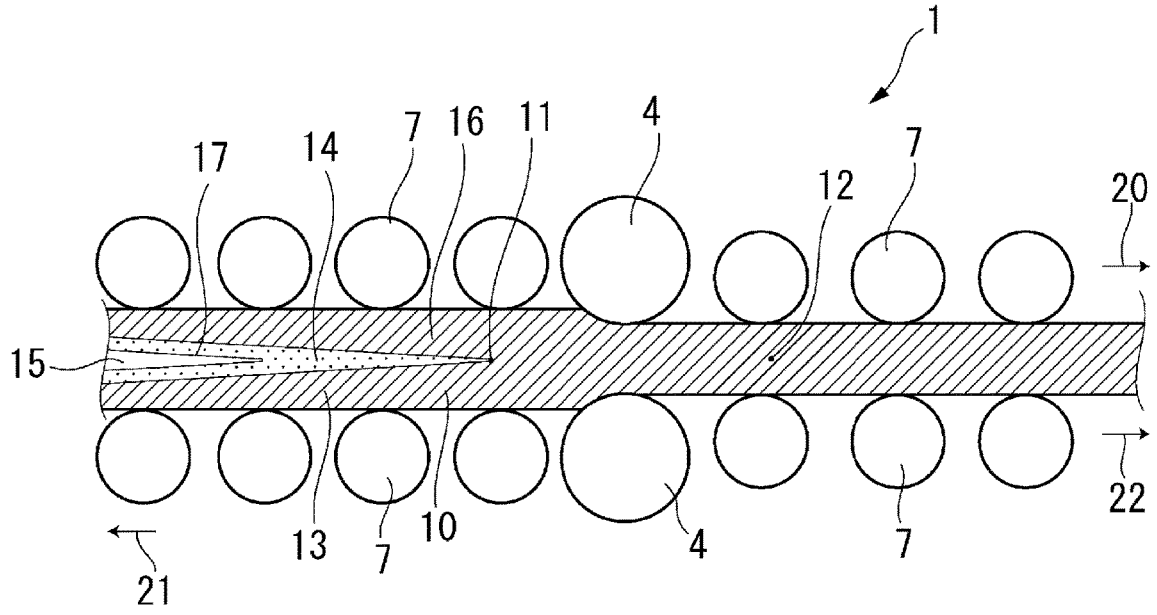
FIG. 2 is a partial cross-sectional view illustrating the vicinity of a machine end of a continuous casting machine.

The relationship between a slab 10 in the vicinity of a solidification completion portion, support rolls 7, and a reduction rolls 4 in a machine of a continuous casting machine 1 will be described with reference to FIG. 2. The inside of the continuous casting machine means the inside of the machine of the continuous casting machine 1 located on an upstream side 21 of the holding furnace 2, and means a portion on the upstream side 21 of the support rolls 7 provided on a most downstream side 22. The slab 10 before the completion of solidification includes a solid phase portion 13, a solid-liquid coexisting phase 14, and a liquid phase portion 15 in this order from the surface. Here, the boundary between the solid phase portion 13 and the solid-liquid coexisting phase 14 is called a solid phase line 16. The boundary between the solid-liquid coexisting phase 14 and the liquid phase portion 15 is called a liquid phase line 17. As the slab 10 moves in a casting direction 20 from the upstream side 21 to the downstream side 22, solidification of the slab 10 progresses and the thickness of the solid phase portion 13 becomes thicker. A portion where the solid phase lines 16 on the upper surface side and the lower surface side of the slab 10 intersect is a solidification completion position 11. The temperature of the central part of the thickness of the slab decreases toward the downstream side of the solidification completion position 11.

A reduction using the reduction rolls 4 in the continuous casting machine is preferably performed on the slab 10 at a rolling reduction of 30% or more at a position where the solidification is completed and a center temperature of the slab is 1300° C. or higher. That is, the rolling reduction in one pass in which the slab 10 is reduced by a set of the reduction rolls 4 at a point on casting line in the continuous casting machine may be 30% or more. The reduction may be performed by a plurality of sets of the reduction rolls 4 at a plurality of points on the casting line in the continuous casting machine. That is, a portion of the slab 10 reduced by the reduction rolls 4 in the casting direction 20 is a position between the solidification completion position 11 and a position where the central part being 1300° C. 12. In other words, the manufacturing apparatus has the reduction rolls 4 in the continuous casting machine 22 on the downstream side of the solidification completion position 11 of the slab 10 and on the upstream side 21 of the position where the central part being 1300° C. 12. The reduction rolls 4 are located on the upstream side 21 of the support rolls 7 which are on the most downstream side in the continuous casting machine. The reason why the reduction position is set after the completion of solidification is that internal cracking occurs when the reduction is performed while the inside is not solidified. The reason why the reduction position is set when the center temperature of the slab is 1300° C. or higher is that an effect of improving the segregation ratio is exhibited under a reduction at 1300° C. or higher. This requirement is usually achieved by reducing the slab 10 during casting in the continuous casting machine. The reason why the slab 10 is reduced at a rolling reduction of 30% or more is that the improvement of the center segregation ratio and the microsegregation ratio can be clearly obtained.

As described above, since the manufacturing apparatus according to the present embodiment performs a reduction on a thin slab having a slab thickness of 70 mm to 120 mm on the upstream side 21 of the holding furnace 2 immediately after the completion of solidification at a rolling reduction as large as 30% or more, a thin steel sheet of a high alloy steel system having little segregation can be stably manufactured by TSCR.

Regarding the maintaining of the temperature of the slab 10 in the holding furnace 2, it is preferable to maintain the temperature of the slab 10 at a furnace atmospheric temperature of 1150° C. or higher and 1300° C. or lower for five minutes or longer. This is because the improvement of the center segregation ratio and the microsegregation ratio can be obtained more clearly by maintain the temperature at 1150° C. or higher for five minutes or longer. On the other hand, the upper limit of the holding temperature is set to 1300° C. because scale is generated and scale defects occur at higher temperatures.

However, even if holding for five minutes or longer in the holding furnace 2 as described above is not performed, when the slab 10 is reduced by using the reduction rolls 4 installed on the downstream side 22 of the solidification completion position 11 of the slab 10 in the continuous casting machine in which the slab thickness is 70 mm to 120 mm at the lower end of the mold, the center segregation ratio and the microsegregation ratio of the slab 10 are improved.

The continuous casting machine 1 mainly includes a mold and a roll band that supports the slab 10 having an unsolidified portion. The roll band includes a roller apron, the support rolls 7, and the like. The support rolls 7 may be rolls provided with rotatable rolls and may be a pinch roll provided with a roll that is driven to rotate and can apply a rotational torque to cause the slab 10 to move in the casting direction 20. Some of the support rolls 7 may be pinch rolls. The pinch roll is usually disposed on the upstream side 21 of the reduction rolls 4.

The slab 10 after being completely solidified is usually rapidly discharged from the continuous casting machine 1. Therefore, even in the present embodiment in which the reduction roll 4 is provided in the continuous casting machine, the distance from the complete solidification position of the slab 10 to the end of the continuous casting machine 1 is about 3 to 5 m, and at a casting speed of 4 to 7 m/min, the slab 10 is discharged to the outside of the apparatus within one minute.

Because of such a short period of time, the temperature of the central part of the slab 10 is approximately 1300° C. or higher even on the outlet side of the continuous casting machine 1. Therefore, it is not always necessary to hold the slab 10 in a furnace held at 1150° C. to 1300° C. for five minutes or longer only for improving the center segregation ratio and the microsegregation ratio. However, in the present embodiment, the continuously cast slab 10 is quickly rolled without being cut. In this case, a surface corner portion of the slab 10 and the like are often at a low temperature even immediately after being discharged from the continuous casting machine 1, and thus cannot be immediately rolled. However, for heating the slab for rolling, it is sufficient to raise the temperature within a short period of time. An induction heating device is known as a device suitable for such heating.

In the present embodiment, either one or both of a holding furnace for maintaining the temperature of the cast slab 10 and a heating furnace for heating the cast slab 10 are collectively referred to as a "holding furnace". The present embodiment is characterized in that the continuous casting machine 1, the holding furnace 2, and a rolling stand 3 are arranged linearly in this order.

A temperature $T_C$ of the central part of the slab in the thickness direction at each position in the casting direction 20 during casting can be obtained by one-dimensional heat transfer solidification analysis (calculation). A position where the temperature $T_C$ of the central part coincides with a solidus temperature $T_S$ is used as the solidification completion position 11. By the same analysis, the position where the central part being 1300° C. 12 can be determined. In the heat transfer solidification analysis, an enthalpy method, an equivalent specific heat method, and the like can be used.

A method for manufacturing a thin steel sheet according to the present embodiment can be carried out using an apparatus for manufacturing a thin steel sheet as illustrated in FIG. 1. That is, the apparatus for manufacturing a thin steel sheet includes the followings which are arranged in order: the continuous casting machine 1 for a thin slab having a slab thickness of 70 mm to 120 mm at the lower end of the mold; the holding furnace 2 that maintains the temperature of the cast slab 10 and/or heats the cast slab 10; and the rolling stand 3 by which finish rolling is performed, in which continuous casting, passing-through the holding furnace, and the finish rolling can be continuously performed without cutting the slab 10. The apparatus for manufacturing a thin steel sheet has the reduction rolls 4 on the downstream side 22 of the solidification complete portion of the slab 10 in the continuous casting machine, and the slab 10 can be reduced by the reduction rolls 4. The reduction rolls 4 are a rolling mill that stretches and rolls the slab 10 by causing the slab 10 to be pinched between a rotating roll and a flat plate or between rotating rolls and passed while being pressed.

The reduction by the reduction rolls 4 in the continuous casting machine 1 is performed at a position after the solidification of the slab 10 is completed. Therefore, the reduction rolls 4 are disposed on the downstream side 22 of the solidification completion position 11 of the slab 10. Since the reduction rolls 4 are disposed in the continuous casting machine in the vicinity of the machine end, a reduction can be performed at an appropriate position. Here, the vicinity of the machine end means an end position of the continuous casting machine 1 or a position within 5 m from the end position. At this position, the reduction can be performed immediately after the central part of the thickness of the slab 10 during casting solidifies. Furthermore, by disposing the reduction rolls 4 in the continuous casting machine, the slab 10 can be reduced when the center temperature of the slab 10 is 1300° C. or higher.

As illustrated in FIG. 1, in the apparatus for manufacturing a thin steel sheet according to the present embodiment, the continuous casting machine 1, the holding furnace 2, and the rolling stand 3 for finish rolling are arranged in this order. Then, this manufacturing apparatus continuously performs continuous casting, passing through the holding furnace, and finish rolling without cutting the slab 10. After the finish rolling, a coiling device 6 coils the thin steel sheet. In a batch type rolling in the related art, there is a top and a bottom for each coil to be rolled, which causes a problem at the time of sheet passing. However, in the present embodiment, since the slab 10 is continuously rolled without being cut, the problem regarding the top and the bottom during sheet passing can be avoided. In addition, since the slab 10 after continuous casting is a thin slab, a rolling load can be reduced even in the manufacturing of a thin steel sheet having a sheet thickness of less than 1.2 mm.

In the present embodiment, the holding furnace 2 has a function of maintaining the temperature of and/or heating the cast slab 10. The holding furnace 2 may be a furnace in which the slab 10 passes through the atmosphere held at a high temperature, that is, a furnace in which the atmosphere through which the slab 10 passes is held at a high temperature, and may be a furnace in which the slab 10 is heated by induction heating.

Regarding the rolling stand 3 by which finish rolling is performed, the number of finishing stands is not limited. When manufacturing a thin material having a sheet thickness of 1.2 mm or less, the number of finishing stands is preferably five or more.

A descaling device 5 is usually disposed between the holding furnace 2 and the rolling stand 3 for finish rolling.

In a line configuration with a general TSCR heat-retaining furnace, it is common to place a slab after continuous casting in the heat-retaining furnace to be soaked, and then perform finish rolling, and rolling is not performed in front of the heat-retaining furnace. This is because it has been considered that when a reduction is performed in front of the heat-retaining furnace, a sheet threading speed in the heat-retaining furnace increases, and the time spent in the heat-retaining furnace becomes shorter, so that the heat-retaining furnace needs to be extended for temperature homogenization. In the present embodiment, unlike the above consideration, a reduction is performed in the continuous casting machine for the purpose of segregation diffusion. According to the common knowledge, it was expected that the reduction causes the time spent in the heat-retaining furnace to be shortened, which would be disadvantageous for segregation diffusion and temperature homogenization. However, as described in detail above, it can be seen that by performing a reduction preferably at a rolling reduction of 30% or higher at a temperature at which the center of the slab is 1300° C. or higher after the completion of solidification, the center segregation ratio and the microsegregation ratio of the slab after the reduction are reduced, so that segregation is diffused even if the retention time in the subsequent holding furnace is short. Furthermore, when a reduction is performed at a center temperature as high as 1300° C. or higher and a rolling reduction of 30% or more in the reduction in the continuous casting machine, an average temperature of a steel sheet cross section is homogenized by the reduction, and a short heat treatment is sufficient for temperature homogenization.

That is, according to the present embodiment, it is possible to provide a method for manufacturing a thin steel sheet of a high alloy steel system having little segregation in TSCR in which a soaking treatment cannot be performed.

A preferable composition of the thin steel sheet used in the method for manufacturing a thin steel sheet of the present embodiment will be described.

The thin steel sheet of the present embodiment preferably includes, as a chemical composition, by mass %; C: 0.01% to 1.0%, Si: 0.02% to 2.00%, Mn: 0.1% to 3.5%, P: 0.02% or less, S: 0.002% to 0.030%, Al: 0.0005% to 0.0500%, N: 0.002% to 0.010%, O: 0.0001% to 0.0150%, and a remainder consisting of Fe and impurities.

C: 0.01% to 1.0%

C is contained to increase the strength of a high strength steel sheet. However, when the C content exceeds 1.0%, weldability deteriorates. On the other hand, when the C content is less than 0.01%, the strength decreases.

Si: 0.02% to 2.00%

Si is an element necessary for suppressing the generation of iron-based carbides in a steel sheet and increasing the strength and formability. However, when the Si content exceeds 2.00%, the steel sheet becomes brittle and ductility deteriorates. On the other hand, when the Si content is less than 0.02%, the strength decreases.

Mn: 0.1% to 3.5%

Mn is added to the steel sheet of the present embodiment in order to increase the strength of the steel sheet. However, when the Mn content exceeds 3.5%, even in the present embodiment, a coarse Mn-concentrated portion is generated in a sheet thickness center portion of the steel sheet, and there is concern that embrittlement may easily occur. When the Mn content exceeds 3.5%, the weldability also deteriorates. Therefore, the Mn content is preferably set to 3.5% or less. From the viewpoint of weldability, the Mn content is more preferably 3.00% or less. On the other hand, when the Mn content is less than 0.1%, an effect of improving center segregation and microsegregation cannot be clearly obtained. From this viewpoint, the Mn content is preferably 0.1% or more, and more preferably 0.5% or more.

P: 0.02% or Less

P tends to segregate in the thickness center portion of the steel sheet, making a welded part embrittled. When the P content exceeds 0.02%, there is concern that the welded part may be significantly embrittled even in the present embodiment.

S: 0.002% to 0.030%

S adversely affects the weldability and manufacturability during casting and hot rolling. In addition, S is bonded to Ti to form sulfides, which prevents Ti from becoming nitrides and indirectly induces the generation of Al nitrides. Therefore, the upper limit of the S content is preferably set to 0.030%. Even though the lower limit of the S content is not particularly specified, the effect of improving the segregation ratio is exhibited. Since setting the S content to less than 0.002% entails a significant increase in manufacturing cost, the lower limit of the S content is set to 0.002%.

Al: 0.0005% to 0.0500%

When Al is added in a large amount, coarse nitrides are formed, a drawing value at a low temperature is lowered, and impact resistance is lowered. Therefore, the upper limit of the Al content is preferably set to 0.050%. The Al content is more preferably set to 0.035% or less in order to avoid the generation of coarse nitrides. Although the effect of improving the segregation ratio is exhibited without particularly specifying the lower limit of the Al content, setting the Al content to less than 0.0005% is accompanied by a significant increase in manufacturing cost. Furthermore, Al is an element effective as a deoxidizing material, and from this viewpoint, the Al content is set to preferably 0.005% or more, and more preferably 0.010% or more.

N: 0.002% to 0.010%

N forms coarse nitrides that act as the origin of fracture at a low temperature and lowers the impact resistance, so that it is necessary to suppress the amount of N added. When the N content exceeds 0.010%, this effect becomes significant. Therefore, the range of the N content is preferably set to 0.010% or less. From this viewpoint, the N content is more preferably 0.0040% or less, and even more preferably 0.0030% or less. Although the effect of improving the segregation ratio is exhibited without particularly specifying the lower limit of the N content, setting the N content to less than 0.002% causes a significant increase in manufacturing cost.

O: 0.0001% to 0.0150%

O forms coarse oxides and causes the origin of fracture at a low temperature, so that it is necessary to suppress the O content. When the O content exceeds 0.0150%, this effect becomes significant. Therefore, the upper limit of the O content is preferably set to 0.0150% or less. From this viewpoint, the content of O is more preferably 0.0020% or less, and even more preferably 0.0010% or less. Although the effect of improving the segregation ratio is exhibited without particularly specifying the lower limit of the O content, setting the O content to less than 0.0001% is accompanied by a significant increase in manufacturing cost.

The thin steel sheet of the present embodiment may optionally further contain the following elements. That is, the thin steel sheet may further contain one or two or more of, by mass %; Ti: 0.005% to 0.030%, Nb: 0.0010% to 0.0150%, V: 0.010% to 0.150%, B: 0.0001% to 0.0100%, Cr: 0.01% to 2.00%, Ni: 0.01% to 2.00%, Cu: 0.01% to 2.00%, Mo: 0.01% to 1.00%, and W: 0.01% to 1.00%. The main effect according to the present embodiment is the improvement of center segregation and microsegregation, and the effect is not particularly affected by the inclusion of the following elements.

Ti: 0.005% to 0.030%

Ti is an element that forms fine nitrides by hot rolling under appropriate conditions and suppresses the generation of coarse Al nitrides, reduces the origin of fracture at a low temperature, and improves the impact resistance. In order to obtain this effect, the Ti content is preferably set to 0.005% or more. On the other hand, when the Ti content exceeds 0.030%, formability of a soft portion in the steel sheet deteriorates due to the precipitation of fine carbonitrides, which results in a decrease in the drawing value at a low temperature. From the viewpoint of formability, the Ti content is preferably 0.0120% or less, and more preferably 0.0100% or less.

Nb: 0.0010% to 0.0150%

Nb is an element that forms fine nitrides by hot rolling under appropriate conditions and suppresses the generation of coarse Al nitrides, and reduces the origin of fracture at a low temperature. In order to obtain this effect, the Nb content is set to preferably 0.0010% or more, and the Nb content is set to more preferably 0.0030% or more, and even more preferably 0.0050% or more. On the other hand, when the Nb content exceeds 0.0150%, the formability of the soft portion in the steel sheet deteriorates due to the precipitation of fine carbonitrides, which results in a decrease in the drawing value at a low temperature. Therefore, the Nb content is preferably 0.0150% or less. From the viewpoint of formability, the Nb content is more preferably 0.0120% or less, and even more preferably 0.0100% or less.

V: 0.010% to 0.150%

V is an element that forms fine nitrides by hot rolling under appropriate conditions and suppresses the generation of coarse Al nitrides, and reduces the origin of fracture at a low temperature. In order to obtain this effect, the V content needs to be 0.010% or more, and the V content is set to preferably 0.030% or more, and more preferably 0.050% or more. On the other hand, when the V content exceeds 0.150%, the formability of the soft portion in the steel sheet deteriorates due to the precipitation of fine carbonitrides, which results in a decrease in the drawing value at a low temperature. Therefore, the V content is preferably 0.150% or less. From the viewpoint of formability, the V content is more preferably 0.120% or less, and even more preferably 0.100% or less.

B: 0.0001% to 0.0100%

B is an element that forms fine nitrides by hot rolling under appropriate conditions and suppresses the generation of coarse Al nitrides, and reduces the origin of fracture at a low temperature. In order to obtain this effect, the B content is set to preferably 0.0001% or more, and the B content is set to preferably 0.0003% or more, and more preferably 0.0005% or more. Furthermore, B is an element effective for high-strengthening by suppressing phase transformation at a high temperature, and may be further added. However, when the B content exceeds 0.0100%, hot workability is impaired, and the productivity is lowered. Therefore, the B content is preferably 0.0100% or less. From the viewpoint of productivity, the B content is more preferably 0.0050% or less, and even more preferably 0.0030% or less.

Cr: 0.01% to 2.00%

Cr is an element effective for high-strengthening by suppressing phase transformation at a high temperature, and may be added in place of a portion of C and/or Mn. When the Cr content exceeds 2.00%, the hot workability is impaired, and the productivity is lowered. Therefore, the Cr content is preferably 2.00% or less. Although the effect of improving the segregation ratio is exhibited without particularly specifying the lower limit of the Cr content, in order to sufficiently obtain the effect of high-strengthening by Cr, the Cr content is preferably 0.01% or more.

Ni: 0.01% to 2.00%

Ni is an element effective for high-strengthening by suppressing phase transformation at a high temperature, and may be added in place of a portion of C and/or Mn. When the Ni content exceeds 2.00%, the weldability is impaired. Therefore, the Ni content is preferably 2.00% or less. Although the effect of improving the segregation ratio is exhibited without particularly specifying the lower limit of the Ni content, in order to sufficiently obtain the effect of high-strengthening by Ni, the Ni content is preferably 0.01% or more.

Cu: 0.01% to 2.00%

Cu is an element that increases the strength by being present in steel as fine particles, and can be added in place of a portion of C and/or Mn. When the Cu content exceeds 2.00%, the weldability is impaired. Therefore, the Cu content is preferably 2.00% or less. Although the effect of improving the segregation ratio is exhibited without particularly specifying the lower limit of the Cu content, in order to sufficiently obtain the effect of high-strengthening by Cu, the Cu content is preferably 0.01% or more.

Mo: 0.01% to 1.00%

Mo is an element effective for high-strengthening by suppressing phase transformation at a high temperature, and may be added in place of a portion of C and/or Mn. When the Mo content exceeds 1.00%, the hot workability is impaired, and the productivity is lowered. From this, the Mo content is preferably 1.00% or less. Although the effect of improving the segregation ratio is exhibited without particularly specifying the lower limit of the Mo content, in order to sufficiently obtain the effect of high-strengthening by Mo, the Mo content is preferably 0.01% or more.

W: 0.01% to 1.00%

W is an element effective for high-strengthening by suppressing phase transformation at a high temperature, and may be added in place of a portion of C and/or Mn. When the W content exceeds 1.00%, the hot workability is impaired, and the productivity is lowered. Therefore, the W content is preferably 1.00% or less. Although the effect of improving the segregation ratio is exhibited without particularly specifying the lower limit of the W content, in order to sufficiently obtain the effect of high-strengthening by W, the W content is preferably 0.01% or more.

The remainder may consist of iron and impurities.

EXAMPLES

Using the apparatus for manufacturing a thin steel sheet in which, as illustrated in FIG. 1, the continuous casting machine 1 for a thin slab having a slab thickness of 100 mm at the lower end of the mold, the holding furnace 2 for heating the cast slab 10, and the rolling stand 3 for finish rolling were arranged in this order, and continuous casting, passing through the holding furnace, and the finish rolling could be continuously performed without cutting the slab 10, a thin steel sheet was manufactured. This manufacturing apparatus has the reduction rolls 4 having a roll diameter of 720 mm in the machine of the continuous casting machine 1 at the end position thereof. The mold size is 100 mm thick×1500 mm wide. The casting speed is 5.0 m/min. The rolling rate of the reduction rolls 4 is the same as the casting speed. The rolling reduction is as shown in Table 3. The reduction position was set to a position where a thickness center temperature of the center of the width of the slab obtained by the heat transfer solidification analysis was the temperature shown in Table 3 after the completion of solidification.

In a case where the holding furnace 2 of a type that maintains the temperature of the cast slab 10 was used, the slab 10 was cut into a predetermined length at the time when the reduced slab 10 was discharged from the continuous casting machine 1 and was placed in the holding furnace 2 installed next to a heating type holding furnace for the furnace residence time determined assuming that the furnace length of the holding furnace 2 was 180 mm at a sheet threading speed obtained from a rolling reduction determined assuming that the slab 10 was not cut, and the slab 10 was returned to the line of the apparatus for manufacturing a thin steel sheet capable of continuously performing the above-mentioned continuous casting, passing through the holding furnace, and finish rolling without cutting the slab 10, whereby a predetermined thin steel sheet was manufactured. In this case, since the slab 10 had been cut once, batch rolling is performed, but the slab 10 was rolled without any problem. An atmospheric temperature inside the holding furnace 2 was set to 1200° C. Table 3 shows the slab thickness and slab speed (holding furnace passing speed) at the machine end of the continuous casting machine 1 and the heat treatment time (holding furnace residence time) in the holding furnace 2.

In a test, casting was performed with the composition of a kind of steel shown in Table 2 to manufacture a hot-rolled steel sheet (thin sheet product) having a sheet thickness of 1.8 mm after finish rolling. Table 3 shows a list of test conditions and thin sheet product quality.

TABLE 2

| Composition (mass %) | | | | | | | | |
|---|---|---|---|---|---|---|---|---|
| C | Si | Mn | P | S | Ti | Al | N | O |
| 0.20 | 1.60 | 2.60 | 0.005 | 0.003 | 0.01 | 0.03 | 0.002 | 0.002 |

TABLE 3

| | Reduction after solidification | | | Continuous casting machine end | | Holding furnace | Thin sheet product quality | | |
|---|---|---|---|---|---|---|---|---|---|
| | Presence or absence | Central part temperature ° C. | Rolling reduction % | Slab thickness mm | Slab speed m/min | Retention time min | Degree of Mn segregation | Hole expansibility % | Evaluation |
| Present Invention Example 1 | Present | 1330 | 20 | 80 | 6.25 | 29 | 1.29 | 49 | Good*1 |
| Present Invention Example 2 | | 1330 | 30 | 70 | 7.14 | 25 | 1.25 | 54 | Good |
| Present Invention Example 3 | | 1330 | 40 | 60 | 8.3 | 21 | 1.18 | 58 | Good |
| Present Invention Example 4 | | 1330 | 50 | 50 | 10 | 18 | 1.09 | 59 | Good |
| Present Invention Example 5 | | 1330 | 30 | 70 | 7.14 | 0 | 1.28 | 50 | Good*1 |
| Comparative Example 1 | Absent | — | — | 100 | 5 | 60 | 1.34 | 40 | No Good |

The degree of segregation of the steel sheet obtained by the above rolling was measured. A solute element to be measured was set to Mn. As the analysis of a Mn concentration, line analysis was performed using EPMA in the thickness direction of the steel sheet with a beam diameter of 50 μm to measure a Mn concentration distribution in the steel sheet, and the maximum concentration of Mn in a measurement range was obtained. A value obtained by dividing the value of the maximum concentration of Mn by the initial Mn content rate obtained from the chemical analysis in a molten steel stage was used as the degree of Mn segregation.

In addition, a sample for a hole expanding test was cut out from the hot-rolled steel sheet, and the hole expanding test was performed in accordance with JIS Z 2256:2010 (Metallic materials-Hole expanding test) to calculate a hole expanding limit value "λ (%)". As a comprehensive evaluation, those with a hole expansibility of 50% or more were evaluated as good, and those with a lower hole expansibility were evaluated as no good.

Present Invention Examples 1 to 4 are examples of a thin steel sheet (thin sheet product) rolled to a predetermined thickness by cutting the slab 10 immediately after being reduced at each rolling reduction at the end position in the continuous casting machine 1, temporarily placing the slab 10 in the temperature maintaining type holding furnace 2, and after the retention time described in Table 3, performing descaling with a descaler and finish rolling thereon.

Present Invention Example 5 is an example of a thin steel sheet manufactured by continuously performing continuous casting, passing through the holding furnace, and finish rolling using the holding furnace 2 for slab heating (induction heating furnace) without cutting the slab 10.

Comparative Example 1 is an example of a thin steel sheet having the same sheet thickness as those of Present Invention Examples 1 to 5 by cutting the slab without performing a reduction at the end position in the continuous casting machine, temporarily placing the slab in the temperature maintaining type holding furnace 2, and after the retention time described in Table 3 performing rolling thereon.

Evaluation (*1) of Present Invention Example 1 means that even if the rolling reduction of the reduction immediately after solidification is small and the hole expansibility is 50% or less, it is superior to Comparative Example 1.

Evaluation (*1) of Present Invention Example 5 means that even if there is no retention time in the holding furnace 2, it is clearly superior to Comparative Example 1. It is considered that the reason for this is that in addition to a 30% reduction performed at the end position in the continuous casting machine, it took about five minutes from the machine end of the continuous casting machine to the inlet of the rolling stand 3 by which finish rolling was performed via the induction heating furnace, so that the diffusion of segregation elements proceeded during the time. As confirmed and shown in Table 1 above, it is considered that center segregation and microsegregation were improved by reducing the slab 10 cast using the continuous casting machine 1 for a thin slab in the continuous casting machine. Therefore, it was confirmed that even if the slab retention time in the holding furnace 2 was not sufficiently secured, the quality of the thin steel sheet rolled by using the induction heating was equal to or higher than that of Comparative Example 1 in which holding in the holding furnace 2 for 60 minutes was performed.

In addition, it was found that under the condition that the slab was cut after continuous casting and was held in the holding furnace 2 for a long period of time, even if the slab was not reduced immediately after solidification, segregation was relaxed and the hole expansibility was improved as long as a heat treatment time of 360 minutes was secured. However, in TSCR, since the slab is continuously processed without being cut, such a heat treatment cannot be performed, and the feasibility is low.

Based on the results of these comparative investigations, it was found that when a thin steel sheet is manufactured by using the apparatus for manufacturing a thin steel sheet in which the continuous casting machine 1 for a thin slab, the holding furnace 2 for maintaining the temperature of the cast slab 10 or heating the cast slab 10, and the rolling stand 3 by which finish rolling is performed are arranged in this order, and continuous casting, passing through the holding furnace, and the finish rolling can be continuously performed without cutting the slab 10, a thin steel sheet having little center segregation and microsegregation can be manufactured as the rolling reduction of the slab 10 at the end position of the continuous casting machine 1 increases and the heat treatment time is lengthened.

Further, in Present Invention Example 5, as a result of manufacturing a thin steel sheet by continuously performing the continuous casting, passing through the holding furnace, and finish rolling without cutting the slab 10, the passability in the rolling stand 3 by which finish rolling was performed was good, and there was no problem in manufacturing a 1.8 mm thick hot-rolled steel sheet from high Mn steel containing 2.6 mass % of Mn. It could be also confirmed that a hot-rolled steel sheet having a smaller thickness such as 0.8 mm could be manufactured by the same method. An effect of improving the passability when rolling the high Mn steel can be obtained also in Present Invention Examples 1 to 4 as in Present Invention Example 5 as long as the holding furnace 2 having a furnace length of the holding furnace 2 of 180 m was installed between the continuous casting machine 1 and the rolling stand 3.

INDUSTRIAL APPLICABILITY

According to the present invention, when manufacturing a thin steel sheet by TSCR, an apparatus for manufacturing a thin steel sheet and a method for manufacturing a thin steel sheet capable of stably manufacturing a thin steel sheet, which is of a high alloy steel system and has less segregation.

BRIEF DESCRIPTION OF THE REFERENCE SYMBOLS

1 Continuous casting machine
2 Holding furnace
3 Rolling stand
4 reduction roll
5 Descaling device
6 Coiling device
7 Support roll
10 Slab
11 Solidification completion position
12 Position where the central part being 1300° C.
13 Solid phase portion
14 Solid-liquid coexisting phase
15 Liquid phase portion
16 Solid phase line
17 Liquid phase line
20 Casting direction
21 Upstream side
22 Downstream side

The invention claimed is:

1. A method for manufacturing a thin steel sheet using an apparatus for manufacturing a thin steel sheet, the method comprising:

providing an apparatus for manufacturing a thin steel sheet, with which continuous casting, passing-through a holding furnace, and finish rolling are able to be continuously performed without cutting a slab, the apparatus comprising the followings which are arranged in order:

a continuous casting machine for a thin slab having a slab thickness of 70 mm to 120 mm at a lower end of a mold;

the holding furnace that is configured to maintain a temperature of a cast slab and/or heats the cast slab; and a rolling stand by which finish rolling is performed, wherein the apparatus has a reduction roll on a downstream side of a solidification completion position of the slab in the continuous casting machine, and the slab is able to be reduced by the reduction roll;

setting a casting speed of the thin slab at the lower end of the mold to 4 to 7 m/min; and reducing the slab at a rolling reduction of 30% or more by the reduction roll after solidification is completed and when a center temperature of the slab is 1300° C. or higher.

2. The method for manufacturing a thin steel sheet using the apparatus for manufacturing a thin steel sheet according to claim 1, the method further comprising:

holding the slab at a temperature of 1150° C. or higher and 1300° C. or lower for five minutes or longer in the holding furnace.

3. The method for manufacturing a thin steel sheet according to claim 2, wherein the thin steel sheet contains, as a chemical composition, by mass %;

C: 0.01% to 1.0%,
Si: 0.02% to 2.00%,
Mn: 0.1% to 3.5%,
P: 0.02% or less,
S: 0.002% to 0.030%,
Al: 0.0005% to 0.0500%,
N: 0.002% to 0.010%,
O: 0.0001% to 0.0150%, and
a remainder containing of Fe and impurities.

4. The method for manufacturing a thin steel sheet according to claim 3, wherein the thin steel sheet further contains one or two or more of, by mass %;

Ti: 0.005% to 0.030%,
Nb: 0.0010% to 0.0150%,
V: 0.010% to 0.150%,
B: 0.0001% to 0.0100%,
Cr: 0.01% to 2.00%,
Ni: 0.01% to 2.00%.

5. The method for manufacturing a thin steel sheet according to claim 1, wherein the thin steel sheet contains, as a chemical composition, by mass %;

C: 0.01% to 1.0%,
Si: 0.02% to 2.00%,
Mn: 0.1% to 3.5%,
P: 0.02% or less,
S: 0.002% to 0.030%,
Al: 0.0005% to 0.0500%,
N: 0.002% to 0.010%,
O: 0.0001% to 0.0150%, and
a remainder containing of Fe and impurities.

6. The method for manufacturing a thin steel sheet according to claim 5, wherein the thin steel sheet further contains one or two or more of, by mass %;

Ti: 0.005% to 0.030%,
Nb: 0.0010% to 0.0150%,
V: 0.010% to 0.150%,
B: 0.0001% to 0.0100%,
Cr: 0.01% to 2.00%,
Ni: 0.01% to 2.00%,
Cu: 0.01% to 2.00%,
Mo: 0.01% to 1.00%, and
W: 0.01% to 1.00%.

7. A method for manufacturing a thin steel sheet using an apparatus for manufacturing a thin steel sheet, the method comprising:

providing an apparatus for manufacturing a thin steel sheet, with which continuous casting, passing-through a holding furnace, and finish rolling are able to be continuously performed without cutting a slab, the apparatus comprising the followings which are arranged in order:

a continuous casting machine for a thin slab having a slab thickness of 70 mm to 120 mm at a lower end of a mold;

the holding furnace that is configured to maintain a temperature of a cast slab and/or heats the cast slab; and a rolling stand by which finish rolling is performed, wherein the apparatus has a reduction roll on a downstream side of a solidification completion position of the slab in the continuous casting machine, and the slab is able to be reduced by the reduction roll; the holding furnace being one of a furnace in which the slab passes through an atmosphere kept at a high temperature and a furnace in which the slab is heated by induction heating, setting a casting speed of the thin slab at the lower end of the mold to 4 to 7 m/min; and reducing the slab at a rolling reduction of 30% or more by the reduction roll after solidification is completed and when a center temperature of the slab is 1300° C. or higher.

8. The method for manufacturing a thin steel sheet using the apparatus for manufacturing a thin steel sheet according to claim 7, the method further comprising:

holding the slab at a temperature of 1150° C. or higher and 1300° C. or lower for five minutes or longer in the holding furnace.

9. The method for manufacturing a thin steel sheet according to claim 8, wherein the thin steel sheet contains, as a chemical composition, by mass %;

C: 0.01% to 1.0%,
Si: 0.02% to 2.00%,
Mn: 0.1% to 3.5%,
P: 0.02% or less,
S: 0.002% to 0.030%,
Al: 0.0005% to 0.0500%,
N: 0.002% to 0.010%,
O: 0.0001% to 0.0150%, and
a remainder containing of Fe and impurities.

10. The method for manufacturing a thin steel sheet according to claim 9, wherein the thin steel sheet further contains one or two or more of, by mass %, Ti: 0.005% to 0.030%,
Nb: 0.0010% to 0.0150%,
V: 0.010% to 0.150%,
B: 0.0001% to 0.0100%,
Cr: 0.01% to 2.00%,
Ni: 0.01% to 2.00%.

11. The method for manufacturing a thin steel sheet according to claim 7, wherein the thin steel sheet contains, as a chemical composition, by mass %;

C: 0.01% to 1.0%,
Si: 0.02% to 2.00%,
Mn: 0.1% to 3.5%,
P: 0.02% or less,
S: 0.002% to 0.030%,
Al: 0.0005% to 0.0500%,
N: 0.002% to 0.010%,
O: 0.0001% to 0.0150%, and
a remainder containing of Fe and impurities.

12. The method for manufacturing a thin steel sheet according to claim 11, wherein the thin steel sheet further contains one or two or more of, by mass %;

Ti: 0.005% to 0.030%,

Nb: 0.0010% to 0.0150%,

V: 0.010% to 0.150%,

B: 0.0001% to 0.0100%,

Cr: 0.01% to 2.00%,

Ni: 0.01% to 2.00%,

Cu: 0.01% to 2.00%,

Mo: 0.01% to 1.00%, and

W: 0.01% to 1.00%.

* * * * *